US005936494A

United States Patent [19]

Pollock

[11] Patent Number: 5,936,494

[45] Date of Patent: Aug. 10, 1999

[54] WAVEGUIDE WINDOW

[75] Inventor: John A. Pollock, Wilton, N.H.

[73] Assignee: Special Hermetic Products, Inc., Wilton, N.H.

[21] Appl. No.: 09/045,459

[22] Filed: Mar. 20, 1998

[51] Int. Cl.[6] ..... H01P 1/08

[52] U.S. Cl. ..... 333/252; 174/152 GM

[58] Field of Search ..... 333/252; 315/39.53; 174/152 GM

[56] References Cited

U.S. PATENT DOCUMENTS

| | | | |
|---|---|---|---|
| 3,828,284 | 8/1974 | Hutchins, IV | 333/252 |
| 3,936,779 | 2/1976 | Achter et al. | 333/252 |
| 4,213,004 | 7/1980 | Acker et al. | 174/151 |
| 4,841,101 | 6/1989 | Pollock | 174/152 GM |
| 4,931,756 | 6/1990 | Doehler et al. | 333/252 |
| 5,600,290 | 2/1997 | Anderson, II | 333/252 |

*Primary Examiner*—Paul Gensler

*Attorney, Agent, or Firm*—Dike, Bronstein, Roberts & Cushman, LLP

[57] ABSTRACT

The waveguide window assembly disclosed herein is particularly adapted for use in conjunction with a waveguide housing of a high expansion material such as aluminum. The window is formed of a glassy material having a relatively low coefficient of thermal expansion and is provided with a frame of a material having a matching coefficient. The housing is provided with an opening for receiving the frame with substantial clearance. A wall member is interposed between the frame and the edges of the opening with solder filling the space between the wall member and the frame and also the space between the wall member and the edges of the opening, the wall member being constructed of a material having a coefficient of thermal expansion which is intermediate those of the housing material and the frame material.

9 Claims, 3 Drawing Sheets

WAVEGUIDE WINDOW

BACKGROUND OF THE INVENTION

The present invention relates to a waveguide window construction and more particularly to such a window construction which will provide a reliable hermetic seal in waveguide systems employing a housing constructed of a material having a high coefficient of thermal expansion such as aluminum.

In some waveguide systems, it is necessary that the waveguide cavity be filled with a selected gas under pressure. In earthbound systems, a source of gas under pressure is normally utilized so that small leaks can be tolerated and thus non-hermetic or O-ring type seals may be used. However, in the compact microwave systems typically used in military weapons and in space systems, the waveguide systems must be hermetically sealed since the space, weight and power penalties for an active pressurization are far too great. Microwave signals are typically coupled into and out of waveguide cavities through windows of a glass or glassy material which can transmit the electromagnetic energy without significant attenuation.

The waveguide window is typically provided with a metal frame having a coefficient of thermal expansion (CTE) which is matched to the glass, e.g. KOVAR. Other, functionally equivalent alloys are known in the art. As is understood by those skilled in the art, the glass materials typically used for microwave windows, e.g. Corning 7052, have an expansion rate of approximately $5\times10^{-6}$ ppm/° C. and the KOVAR alloy essentially matches that expansion. Corning 7070 with a CTE of about 3 may also be used. Attachment of the window to the frame is accomplished by direct glass flow to an oxide layer on the frame or by a glass metalization process which allows the glass to be subsequently soldered to the KOVAR frame, the KOVAR frame also being plated to facilitate the solder attachment.

In prior art implementations of waveguide windows, the frame assembly is typically soldered to the waveguide housing or assembly. The solder joints on these prior art designs are typically thin and of a design which places the solder joint in shear under thermal cycling conditions. However, when the waveguide housing is constructed of aluminum, difficulties have been encountered due to the extremely high strains which are generated by differential expansion when the assembly is subjected to thermal cycling. If a hard solder is used, such as 80/20 Au/Sn, the strains may be passed to the glass which can fracture. If soft solder is used, the thermal cycling may cause solder fissuring and a loss of hermeticity. The origins of the strains are thus similar to those occurring in hermetically sealed feedthroughs which were the subject of my previously issued U.S. Pat. No. 4,841,101.

In accordance with the practice of the '101 patent, strains were reduced to a manageable level by providing a thicker and more uniform layer of solder around a feedthrough ferrule, e.g. a thickness defined by means of a flange on the inner end of the feedthrough ferrule. Waveguide windows, however, are typically much larger than electrical feedthroughs so that the strains produced by differential thermal expansion are substantially larger, preventing the straightforward application of the technique taught in the '101 patent.

Among the several objects of the present invention may be noted the provision of a novel waveguide window construction; the provision of such a construction which facilitates the maintenance of a hermetic seal; the provision of such a construction which may be employed with waveguide housings of a metal having a high coefficient of thermal expansion; the provision of an assembly which is highly reliable and which is of relatively simple and inexpensive construction. Other objects and features will be in part apparent and in part pointed out hereinafter.

SUMMARY OF THE INVENTION

The radiation transmissive window assembly of the present invention is adapted for use in a waveguide assembly employing a housing of a relatively high coefficient of thermal expansion material. The window is formed of a glassy material having a relatively low coefficient of thermal expansion and is provided with a frame of a material having a coefficient of thermal expansion which approximates that of the glassy material. The housing is provided with an opening for receiving the frame with substantial clearance between the frame and the edges of the opening. A wall member is interposed between the frame and the edges of the opening with solder filling the space between the wall member and the frame and also the space between the wall member and the edges of the opening. Preferably, the wall member constructed of a material having a coefficient of thermal expansion which is intermediate those of the housing material and the frame material.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
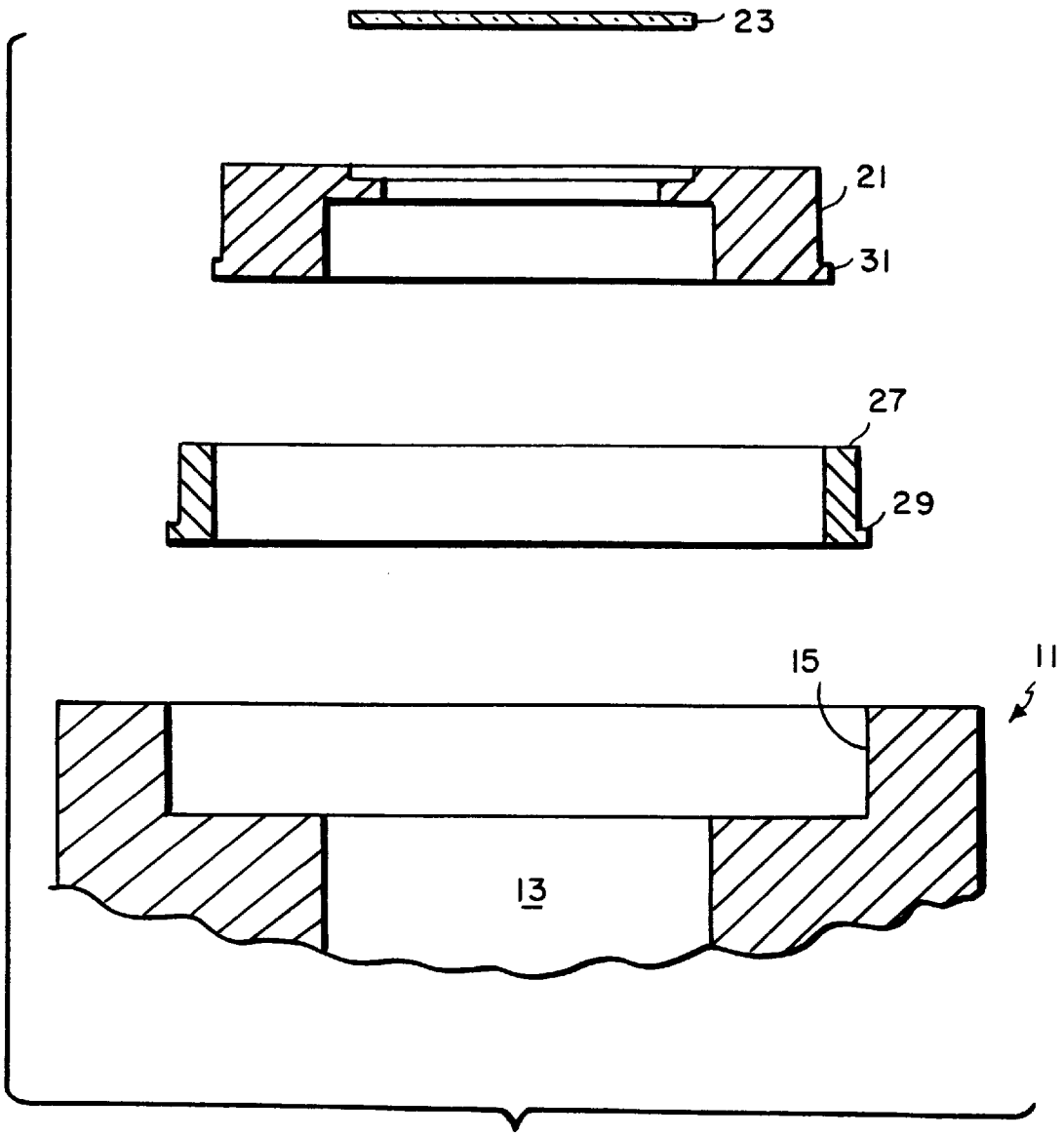
FIG. 1 is an exploded view of components of a waveguide assembly incorporating a radiation transmissive window in accordance with the present invention.
Figure 2:
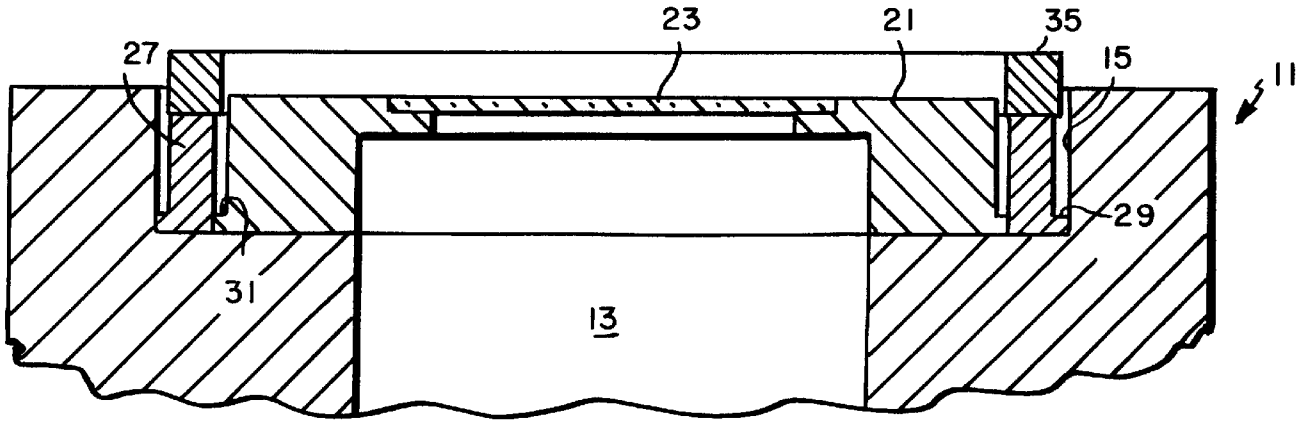
FIG. 2 illustrates the components in assembled relationship together with a solder preform.

Referring now to FIGS. 1 and 2, the housing of a waveguide assembly is indicated generally by reference character 11. The housing provides a waveguide cavity designated generally by reference character 13. The housing is preferably constructed of aluminum which has a relatively high coefficient of thermal expansion, i.e. $23\times10^{-6}$ ppm/° C. The housing 11 incorporates, at the end of the cavity 13, a countersunk opening 15 for receiving a radiation transmissive window.

A KOVAR frame 21 receives a window 23 constructed of a glass or glassy: material. Rather than fitting closely within the opening 15, the KOVAR frame 21 is substantially smaller than the opening 15 so that significant or substantial clearance or space is provided. Within this space is placed a wall member 27. Wall member 27 is preferably constructed of a metal having a coefficient of thermal expansion which is intermediate those of the housing material and the frame material. A presently preferred material for the wall member 27 is cold rolled steel (CRS) which has a coefficient of thermal expansion of $14\times10^{-6}$ ppm/° C.

The innermost portions of the frame 21, wall member 27 and housing opening 15 incorporate cooperating structure or shape so that most of the height of the wall member is spaced from both the sides of the opening and from the frame by a distance which is on the order of 0.005 inches. In the particular embodiment illustrated, this structure is provided by an outwardly projecting flange or rim 29 on the innermost portion of the wall member 27 and a similar rim or flange 31 on the innermost portion of the frame 21. As will be understood by those skilled in the art, it would be substantially equivalent to put rims on both the inside and outside of the wall member or to utilize a step at the innermost end of the opening together with a rimmed window frame and entirely straight sided wall member, the purpose in each case being to establish the desired spacing.

Figure 3:
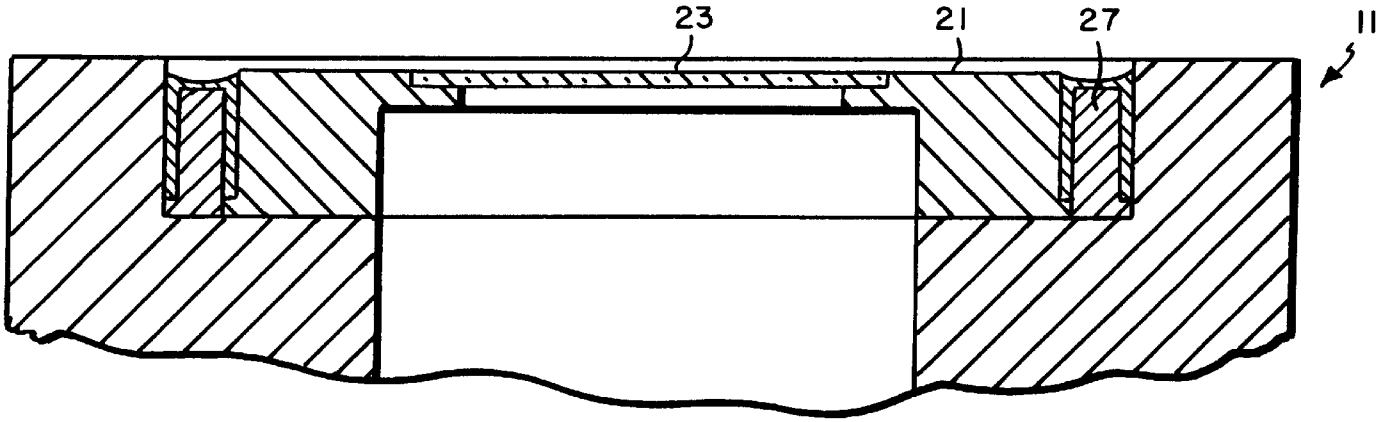
FIG. 3 illustrates the waveguide window assembly after the components have been soldered together.

FIG. 2 illustrates the components of the window system assembled together with a solder preform 35. The solder of the preform is a suitable soft solder which provides compliance. Examples of appropriate solders are those of Federal Specification Registrations Sn96, Sn63, Sn62 and Sb5. FIG. 3 illustrates the assembly after it has been heated so that the solder from the preform has flowed into the spaces between the wall member and the edges of the housing and the space between the wall member and the frame 21. As may be seen, this arrangement splits the strain produced by differential thermal expansion between two layers of solder. Each layer is of a thickness which allows it to remain within the range of strains which will accommodate many thermal cycles without fissuring or losing hermeticity.

As is also explained in my earlier '101 patent, a thickness of about 0.005 inches provides what is conveniently termed a maximally compliant solder thickness. A thinner solder joint, e.g. less than 0.001 inch as was utilized by the prior art, does not have adequate radial compliance and will likely fail under thermal cycling. On the other hand, significantly thicker clearances, e.g. 0.010 inch, will not provide a suitable capillary action for yielding a uniform filling of solder into the radial gap.

Figure 4:
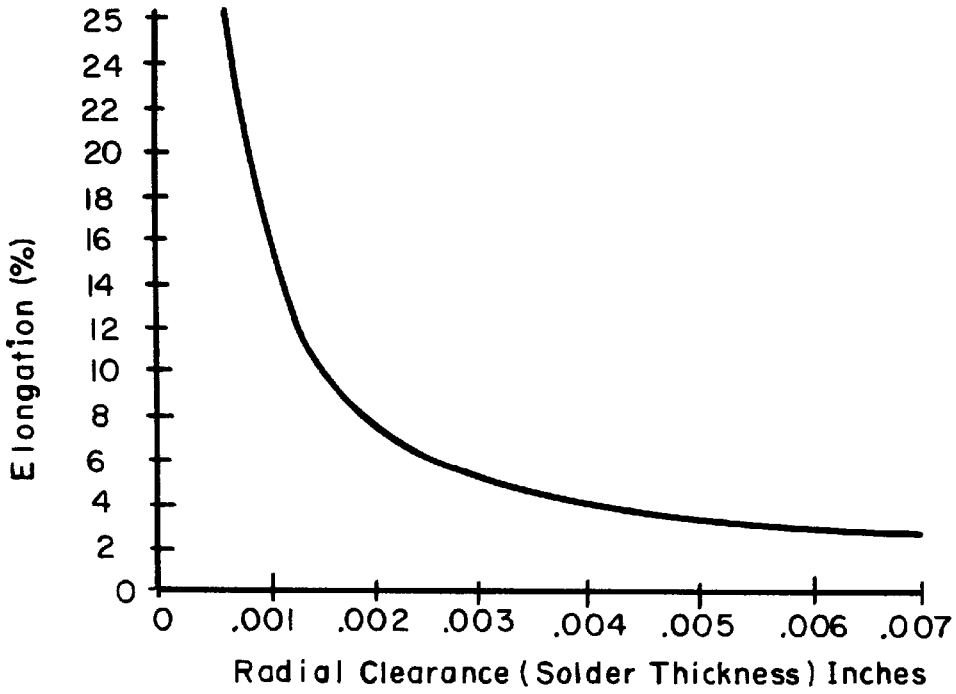
FIG. 4 is a graph representing the critical variation of solder joint elongation for changing solder joint thickness.

With reference to FIG. 4, there is illustrated a graph representing theoretical radial elongation of the solder joint versus radial thickness of the solder joint over a standard range of temperatures, i.e. minus 65 degrees C. to plus 125 degrees C., as called for by certain military test specifications. Below 0.001 inch radial clearance, the radial elongation rises rapidly. As indicated previously, such radial elongation will most likely cause failure of the solder joint in thermal cycling. In one sense, it may be understood that the thin solder joint does not have sufficient radial compliance to accommodate the differential expansion which occurs between KOVAR and aluminum. On the other hand, over a range of radial thickness from about 0.003 to 0.007 inch, the percent radial elongation has dropped to a relatively low level, i.e. about two to five percent. This is a level which can be tolerated by the solder joint without significant failure rates. As indicated previously, a significantly thicker solder joint (e.g. 0.010 inch) is disadvantageous as a practical matter since such a large gap will not provide suitable capillary action for yielding a uniform filling of solder into the radial gap. Thus, a solder joint thickness between 0.003 and 0.007, i.e. in the order of 0.005 inch, may be considered to provide a practically maximally compliant solder joint.

Figure 5:
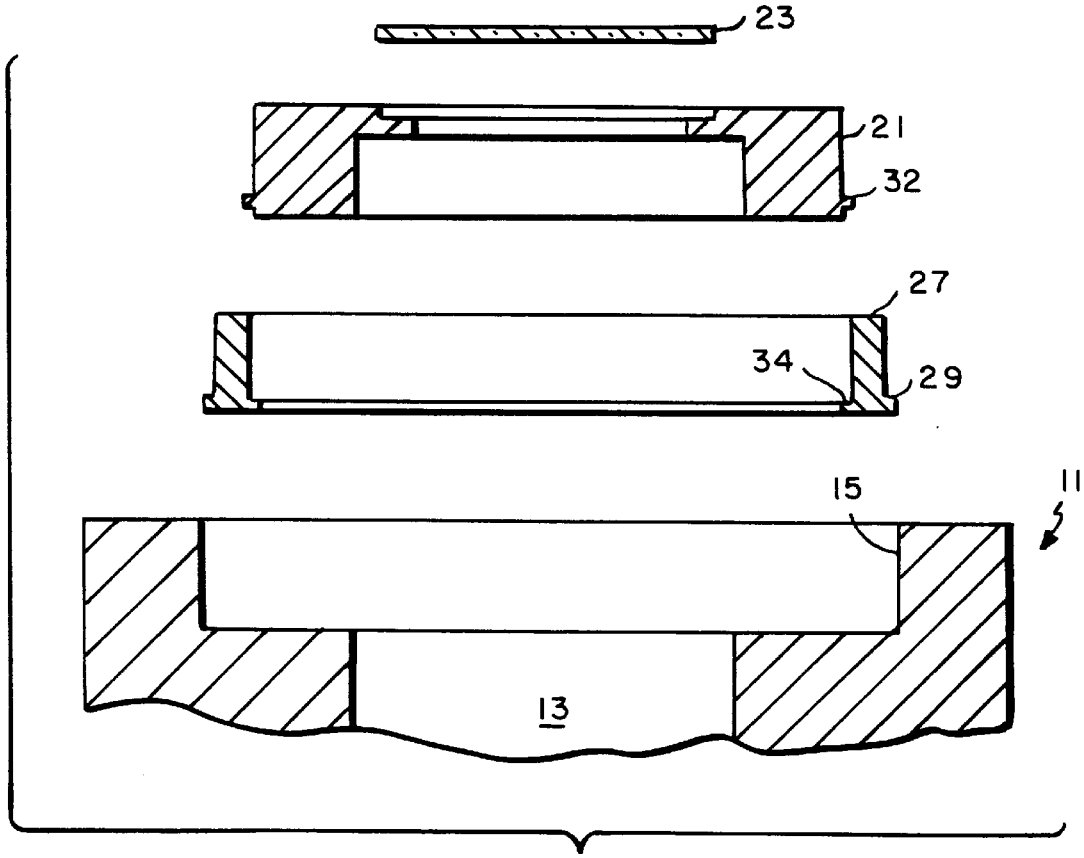
FIG. 5 illustrates components of an alternate design.

FIG. 5 illustrates alternative arrangements of the waveguide window assembly. In this embodiment, the KOVAR frame 21 incorporates an outwardly projecting rim or flange 32 which does not extend completely to the innermost face of the frame but, rather, is slightly undercut. Further, the wall member 27 incorporates an inwardly projecting shallow rim or flange 34 which underlies the frame rim 32 when the elements are assembled. Accordingly, the weight of the frame 21 acts to hold down the wall member 27 during soldering and inhibiting any tendency of the wall member to float upwardly if molten solder works its way under the base of the wall member.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. In an electromagnetic radiation waveguide assembly employing a housing of a relatively high coefficient of thermal expansion (CTE) material, a radiation transmissive window assembly comprising:

a window formed of a glassy material;

said window being enclosed in a frame of a material which has a CTE which approximates that of said glassy material, said housing having an opening for receiving said frame with substantial clearance between said frame and the sides of said opening;

a wall member fitting between the sides of said opening and said frame, said housing, said frame, and said wall member incorporating cooperating structure for spacing said wall member from both the sides of said opening and said frame by a distance in the order of 0.005 inches; and solder filling the spaces between said wall member and said frame and between said wall member and the edges of said opening.

2. A window assembly as set forth in claim 1 wherein said wall member is constructed of a material having a CTE which is intermediate those of said housing material and said frame material.

3. A window assembly as set forth in claim 2 wherein said housing material is aluminum.

4. A window assembly as set forth in claim 3 wherein said wall member is steel.

5. In an electromagnetic radiation waveguide assembly employing a housing of a relatively high coefficient of thermal expansion (CTE) material, a radiation transmissive window assembly comprising:

a window formed of a glassy material having a relatively low CTE;

said window being enclosed in a frame of a material which has a CTE which approximates that of said glassy material, said housing having an opening for receiving said frame with substantial clearance between said frame and the sides of said opening;

a wall member constructed of a material having a CTE which is intermediate those of said housing material and said frame material, said housing, said frame, and said wall member incorporating cooperating structure for spacing said wall member from both the sides of said opening and said frame by a distance which is substantially equal to the thickness of a maximally compliant solder joint; and solder filling the spaces between said wall member and said frame and between said wall member and the edges of said opening.

6. A window assembly as set forth in claim 5 wherein said housing material is aluminum.

7. A window assembly as set forth in claim 5 wherein said wall member is steel.

8. In an electromagnetic radiation waveguide assembly employing an aluminum housing, a radiation transmissive window assembly comprising:

a window formed of a glassy material;

said window being enclosed in a frame of a material which has a coefficient of thermal expansion (CTE) which approximates that of said glassy material, said housing having an opening for receiving said frame with substantial clearance between said frame and the sides of said opening;

a wall member constructed of a material having a CTE which is intermediate those of said housing material and said frame material fitting between the sides of said opening and said frame, said housing, said frame, and said wall member incorporating cooperating structure for spacing said wall member from both the sides of said opening and said frame by a distance in the order of 0.005 inches; and solder filling the spaces between said wall member and said frame and between said wall member and the edges of said opening.

9. A window assembly as set forth in claim 8 wherein said wall material is steel.

* * * * *